US005730016A

United States Patent [19]

Zittel

[11] Patent Number: 5,730,016

[45] Date of Patent: Mar. 24, 1998

[54] METHOD AND APPARATUS FOR ELECTROMAGNETIC FORMING OF THIN WALLED METAL

[75] Inventor: Gunter H. Zittel, San Diego, Calif.

[73] Assignee: Elmag, Inc., San Diego, Calif.

[21] Appl. No.: 620,291

[22] Filed: Mar. 22, 1996

[51] Int. Cl.[6] ..... B21D 26/14

[52] U.S. Cl. ..... 72/56; 72/430

[58] Field of Search ..... 72/56, 54, 430

[56] References Cited

U.S. PATENT DOCUMENTS

| | | | |
|---|---|---|---|
| 2,976,907 | 3/1961 | Harvey et al. | 72/56 |
| 3,124,726 | 3/1964 | Howland . | |
| 3,345,732 | 10/1967 | Brower | 72/56 |
| 3,345,844 | 10/1967 | Jansen et al. . | |
| 3,461,699 | 8/1969 | Roth | 72/56 |
| 3,797,294 | 3/1974 | Roth | 72/56 |
| 4,116,031 | 9/1978 | Hansen et al. | 72/56 |
| 4,135,379 | 1/1979 | Hansen et al. | 72/56 |
| 4,947,667 | 8/1990 | Gunkel et al. | 72/56 |
| 4,990,805 | 2/1991 | Zieve . | |
| 5,058,408 | 10/1991 | Leftault, Jr. et al. | 72/56 |
| 5,331,832 | 7/1994 | Cherian et al. | 72/56 |
| 5,353,617 | 10/1994 | Cherian et al. | 72/56 |
| 5,420,518 | 5/1995 | Schafer, Jr. . | |

*Primary Examiner*—David Jones

*Attorney, Agent, or Firm*—Knobbe, Martens, Olson & Bear, LLP

[57] ABSTRACT

An apparatus for deforming a sheet metal workpiece comprises an inductor for generating a magnetic field, a die comprised of substantially non-conductive material, and a workpiece comprised of substantially conductive material situated such that a current flowing in the inductor creates a magnetic field forcing the workpiece toward the surface of the die. Preferably, a flux transfer member is provided between the inductor and the workpiece to improve forming efficiency. In one preferred embodiment, the workpiece is an aluminum beverage container having a wall thickness of approximately 0.004 to 0.008 inches. In this embodiment, the waveform of the inductor current preferably comprises damped oscillations, and the frequency of the oscillations is approximately 20 to 60 kilohertz.

21 Claims, 5 Drawing Sheets

METHOD AND APPARATUS FOR ELECTROMAGNETIC FORMING OF THIN WALLED METAL

BACKGROUND OF THE INVENTION

1. Field of the Invention

The present invention relates to the electromagnetic forming of thin metal, and more specifically to the electromagnetic forming of shaped or stylized aluminum containers.

2. The Prior Art

Methods for using a pulsed magnetic field to form or shape a metal workpiece have been known for several decades. Although the physical principles behind the process were well established by the early 20th century, it was not until the 1960s that circuits were constructed which were capable of producing the high currents and magnetic fields necessary to generate forces greater than the yield strength of practical metal materials. One early patent covering this technology, U.S. Pat. No. 2,976,907, was issued to Harvey et al. in 1961. The disclosure of the U.S. Pat. No. 2,976,907 is hereby incorporated by reference in its entirety.

Systems utilizing this metal forming technique typically include a workpiece to be formed, a coil for generating a pulsed magnetic field, and a die contoured to the desired workpiece shape. Prior to forming, the workpiece is positioned between the coil and the die. When a current pulse is forced through the coil, a pulsed magnetic field is created. This varying magnetic field induces a current in the workpiece. The moving charges in the workpiece are repelled away from the coil by the magnetic field, and the workpiece itself is therefore forced away from the coil and against the die.

As electromagnetic metal forming technology has developed, many applications for it have been found. For example, U.S. Pat. No. 4,116,031 to Hansen et al. describes an electromagnetic dent puller having a single turn secondary coil driven by two primary coils wherein an axial pulling force relative to the secondary coil may be generated at a specific location in a sheet metal workpiece. U.S. Pat. No. 5,353,617 to Cherian et al. discloses a method of electromagnetically expanding metal sleeves for use in xerographic apparatus. In Cherian et al., a cylindrical metal sleeve is inserted into a hollow cylindrical steel die having an inner radius equal to the desired outer radius of the sleeve. A coil inserted into the sleeve then creates a magnetic field when a current pulse is forced through it. As described above, induced current in the sleeve creates a repulsive force which expands the sleeve against the inner surface of the die.

The Cherian et al. patent describes some of the problems associated with expanding sleeves electromagnetically. For example, the surface may be distorted by seams or other imperfections in the die. Also, air pockets trapped between the outer surface of the sleeve and the inner surface of the die can cause deformations in the resulting sleeve contour.

In principle, forming stylized aluminum containers is possible using methods similar to those described in Cherian et al. The problems described in Cherian et al., however, are magnified as the thickness of the metal being formed is decreased. As the metal thickness is decreased, the repulsive force produced by the magnetic pulse is decreased. Furthermore, air pockets more easily form significant surface deformations. An additional problem with forming stylized aluminum containers arises because they have an integral bottom panel. Since a forming coil cannot extend through this bottom panel, the magnetic flux density is low near the bottom of the container, and the forming process is therefore inefficient in this region.

Prior to the present invention, these problems have rendered electromagnetic forming of stylized or contoured aluminum containers unsuitable. What is needed, therefore, is an apparatus for forming thin metal such as the walls of stylized aluminum containers which maximizes forming efficiency, minimizes air pocket deformations, and can provide effective forming near the container bottom panel.

SUMMARY OF THE INVENTION

The present invention provides a method and apparatus for efficient and high quality electromagnetic forming of thin metal. A preferred embodiment of the present invention is especially suitable for the electromagnetic forming of stylized or contoured aluminum containers.

In accordance with the present invention therefore, an apparatus for deforming a sheet metal workpiece comprises an inductor for generating a magnetic field, a flux transfer member substantially adjacent to the inductor, a die comprised of substantially non-conductive material spaced away from a surface of the flux transfer member, and a workpiece comprised of substantially conductive material situated substantially between the flux transfer member and the die such that a current flowing in the inductor induces a current in the flux transfer member which creates a magnetic field forcing the workpiece toward the surface of the die.

When utilized to form aluminum containers, such an apparatus provides higher quality and more efficient forming. For example, the non-conductive die prevents the introduction of undesired die currents. Furthermore, the flux transfer member produces high quality forming near the bottom of the container. Preferably, the die comprises a ceramic material, which is beneficial for wear and cooling concerns.

Another embodiment of a metal forming apparatus according to the present invention comprises a capacitor for storing charge, an inductor interconnected with the capacitor for generating a magnetic field, a die spaced away from the inductor, a metal workpiece comprised of substantially conductive material and having thickness of less than approximately 0.01 inches situated substantially between the inductor and the die such that a pulsed current flowing in the inductor creates a magnetic field forcing the workpiece toward the die, wherein the capacitance of the capacitor and the inductance of the inductor define a current pulse width, and wherein the current pulse width is chosen to approximately maximize the transfer of kinetic energy to the workpiece. In this embodiment, the correct pulse width will maximize forming efficiency. If the pulse width is too short, the electromagnetic force acts for too short a period, and if the pulse width is too wide, only a small portion of the magnetic field acts on the workpiece.

Improved methods of electromagnetically forming thin aluminum are also provided by the present invention. For example, a method of electromagnetically forming aluminum having a thickness of approximately 0.004 to 0.008 inches comprises placing at least a portion of the aluminum proximate to an inductor and conducting a time varying current through the inductor. In this embodiment, the waveform of the time varying current comprises damped oscillations, and the frequency of the oscillations is approximately 20 to 60 kilohertz. This current waveform has been found to maximize forming quality and efficiency for this type of workpiece.

In a preferred embodiment of this invention, the thin aluminum is a beverage container to be formed into a die comprised of non-conductive material, and the inductor is placed substantially inside the beverage container. Most preferably, the region between the die and the container is evacuated of air. This helps prevent air pockets from deforming the surface of the formed container.

DETAILED DESCRIPTION OF THE PREFERRED EMBODIMENT

Figure 1:
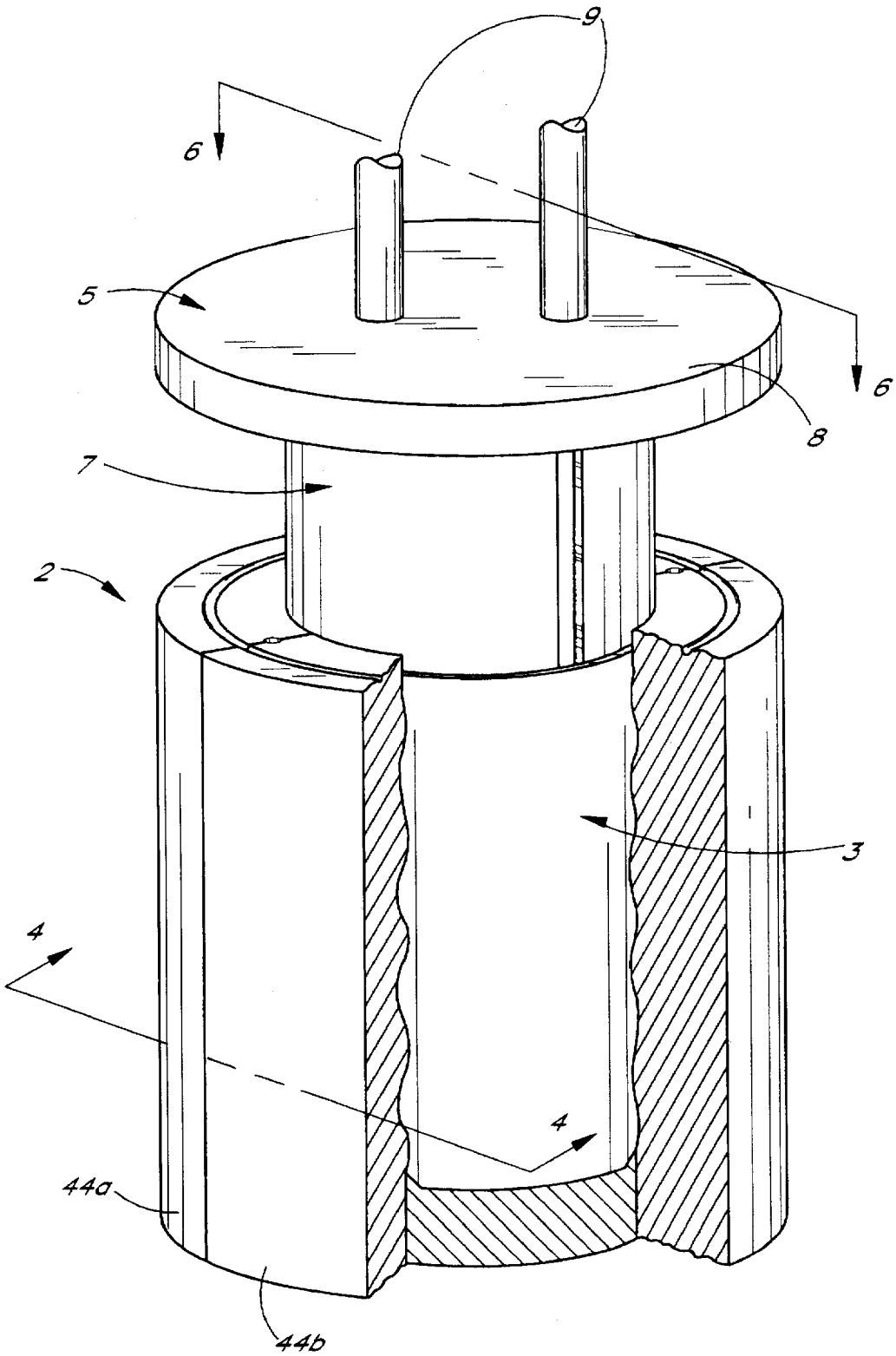
FIG. 1 is a perspective view of a preferred embodiment of a thin metal forming apparatus according to the present invention.

The present invention is described herein with reference to the accompanying Figures, where like numerals refer to like elements throughout. FIG. 1 is a perspective view of one preferred embodiment of an electromagnetic metal forming apparatus according to the present invention. The apparatus comprises a cylindrical die 2 having a hollow interior which is adapted to accept a workpiece such as an open top aluminum container 3, which in one preferred embodiment here described is an industry standard 12 oz aluminum beverage container. As will be explained more fully below with reference to FIGS. 5 and 6, the container is initially cylindrical in shape, and the interior surface of the die 2 is contoured in a desired non-cylindrical shape to which the container is intended to conform after the electromagnetic forming process described herein is completed. Of course, the container need not initially be cylindrical, but may comprise other initial shapes. For example, it may be desireable for the container to be tapered or otherwise partially preformed.

An inductor comprising several turns of wire is embedded in a plastic support structure 5 which is then placed inside the aluminum container 3. Although the support structure is shown in FIG. 1 extending out of the top of the container 3, in operation it is inserted completely inside the container 3, with the bottom surface of the top flange portion 8 of the support structure in contact with the top surface of the die 2. Preferably, the support structure containing the inductor is provided with a flux transfer member 7 comprising a split cylindrical sleeve which surrounds the portion of the support structure which is placed inside the container 3. The leads 9 of the inductor are routed outside the support structure 5, and are connected to a circuit which forces a large current through the inductor to create the metal forming magnetic field.

Figure 2:
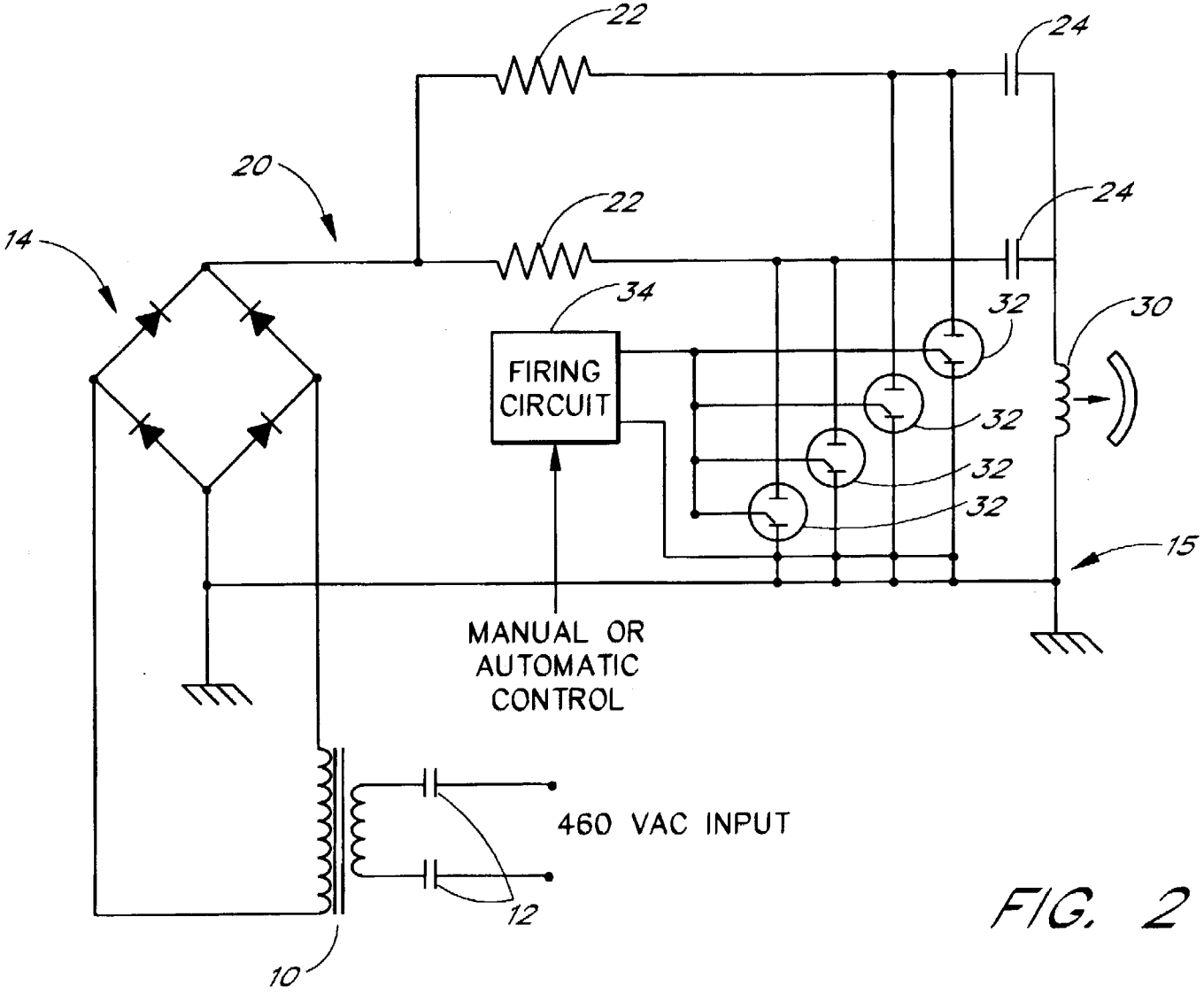
FIG. 2 is a schematic illustration of a circuit for energizing the forming coil in a preferred embodiment of the present invention.

FIG. 2 illustrates a preferred circuit for generating the large current pulse producing the metal forming magnetic field according to the present invention. A high voltage step up transformer 10 has its primary winding connected to an input AC voltage source, typically 460 VAC, through series current limiting capacitors 12. The high voltage output of the transformer 10 feeds a full-wave bridge rectifier 14 comprised of four commercially available high voltage diodes well known in the art. The positive terminal of the rectifier 14 is connected at node 20 through resistors 22 to the positive terminals of two charge storage capacitors 24. The negative terminals of the charge storage capacitors 24 are connected to the circuit common at node 15 (preferably tied to earth) through an inductor 30. As will be described in more detail below, current pulses through the inductor 30 create a magnetic field which is responsible for metal forming. The positive terminal of each of the charge storage capacitors also connects to the anode of two commercially available ignitrons 32, which are normally in an open circuit condition, and which operate essentially as high current remotely controllable switches. The cathode of each ignitron 32 is connected to earth at node 15.

It will be apparent to those in the art that many modifications to the circuit shown in FIG. 2 may be made while retaining a suitable charge storage and discharge circuit. Capacitor 24 polarity could be reversed, and many components shown in FIG. 2 could be substituted with other types. For example, the circuit of FIG. 2 is shown with two charge storage capacitors 24 and with two ignitrons 32 for each of those capacitors 24. It can be readily appreciated by those of skill in the art, however, that more or fewer capacitors 24 could be provided and connected in an analogous manner as the two shown in FIG. 2, and that such charge storage capacitors could be interconnected in series or in parallel without fundamentally changing the character of the circuit. Similarly, only one or more than the two illustrated ignitrons 32 could be provided, depending on the current rating of the ignitrons chosen and the magnitude of the current pulse to be produced by the apparatus. Furthermore, other types of high current switching devices could be utilized in place of the ignitrons.

It can be appreciated from examination of FIG. 2 that when the ignitrons 32 are in the open circuit condition, the positive terminals of the charge storage capacitors 24 will be held near the peak value of the transformer 10 secondary output voltage. This secondary output voltage can vary over a wide range without affecting the basic nature of the apparatus, but is typically in the range from approximately 3000 to 15,000 VAC. A voltage of 5,000 to 10,000 Vdc across the charge storage capacitors 24 has been found suitable for use with the present invention. The capacitance of the charge storage capacitors 24 can also vary widely without departing from the scope and spirit of the present invention. Typically, the charge storage capacitors have a capacitance of 10 to 100 microfarad, with approximately 15 microfarad having been found especially suitable for use with the present invention.

The inductor 30 is connected between earth at node 15 and the negative terminals of the charge storage capacitors 24. It can be appreciated therefore, that when the capacitors 24 have been charged by the power supply circuit and the ignitrons 32 are in an open circuit condition, the inductor 30 and negative terminals of the capacitors 24 are held at ground potential.

Figures 3A, 3B:
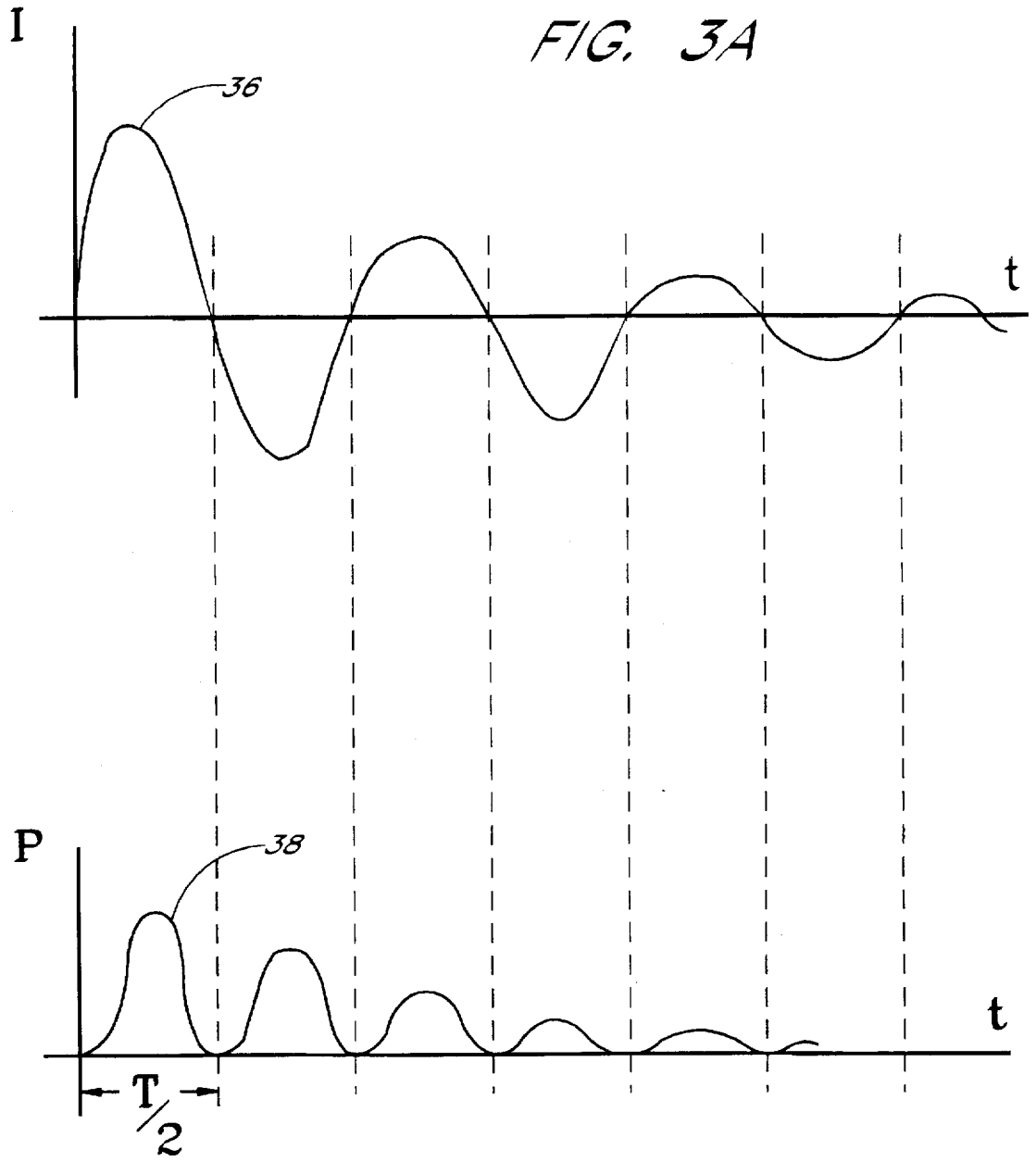
FIG. 3*a* is a graph of the coil current as a function of time produced by the circuit of FIG. 2.
FIG. 3*b* is a graph of the forming pressure on a workpiece as a function of time produced by the current pulse of FIG. 3*a*.

To create the high current metal forming pulse, the ignitrons 32 are fired into their short circuit conductive state by an approximately 3500V signal applied between the ignitron 32 firing terminals and the ignitron anodes by a firing circuit 34. Production of this signal can be automatic or it can be controlled manually in many ways well known to those in the art, depending on the metal forming application the apparatus is being utilized for. When the ignitrons are fired, current flows out of the charge storage capacitors 24 and through the inductor 30. In one embodiment, the current pulse is characterized by a typical LRC discharge waveshape 36, as is illustrated in FIG. 3*a*. However, to increase the life of the circuit components, the basic circuit of FIG. 2 may be modified by adding a parallel damping circuit across the inductor. In this case, the output current pulse is clipped to zero after the first half of the period. Other variations are also possible without affecting the forming effect of the electromagnetic pulse. The peak amplitude of the current pulse is typically 50,000 to 400,000 amperes, with approximately 75,000 amperes having been found advantageous for forming thin walled stylized aluminum containers.

The decay rate of the current waveform is determined by the capacitance of the charge storage capacitors 24 and the resistance of the inductor 30 and interconnecting wiring. The oscillation period T, which defines an initial pulse width of T/2, is related to the inductance of the inductor 30 and the capacitance of the storage capacitors 24, and is proportional to $(LC)^{1/2}$. When a conductive metal workpiece is placed adjacent to the inductor 30, the magnetic field created by the current in the inductor 30 induces a current in the workpiece which tends to force the workpiece away from the inductor 30. The pressure produced on the workpiece is proportional to the square of the amount of current through the inductor 30 as is illustrated in the pressure waveform 38 of FIG. 3*b*. The peak magnitude of the pressure depends on the arrangement of the system elements and the physical characteristics of the workpiece and the metal forming apparatus. Pressures as high as 50,000 psi can be achieved for some geometries and materials. In the preferred embodiment of FIG. 1, the repulsive pressure forces the walls of the container outward toward the inside surface of the die.

To successfully form thin metal, that is, metal having a thickness that is less than approximately 0.020 inches, certain aspects of the metal forming apparatus require a design not employed in the prior art electromagnetic metal forming devices. This is especially true when electromagnetic forming is used for shaping aluminum containers having integral bottom panels.

Figure 4:
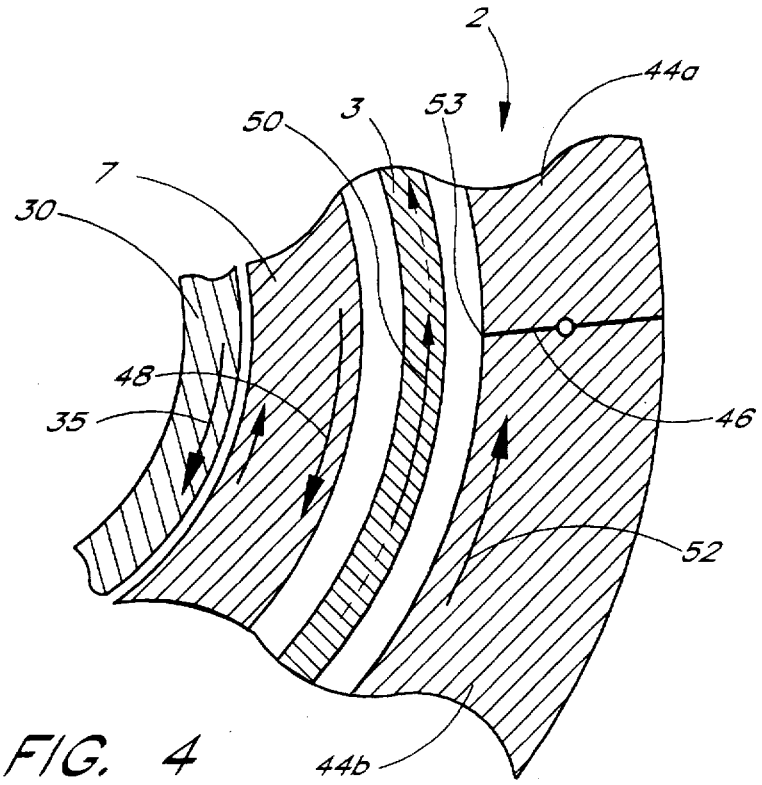
FIG. 4 is a magnified partial cross sectional view along lines 4—4 of the thin metal forming apparatus illustrated in FIG. 1.

FIG. 4 illustrates a magnified partial cross section of a flux transfer member 7 (which surrounds an inductor 30), an aluminum container workpiece 3, and a die 2. As is described in more detail below, an inductor current pulse 35 induces an approximately matching flux transfer member current pulse 48 at the outer surface of the flux transfer member 7. In this embodiment, it is this current 48 in the flux transfer member 7 which is directly associated with creating the metal forming magnetic field.

Figure 5:
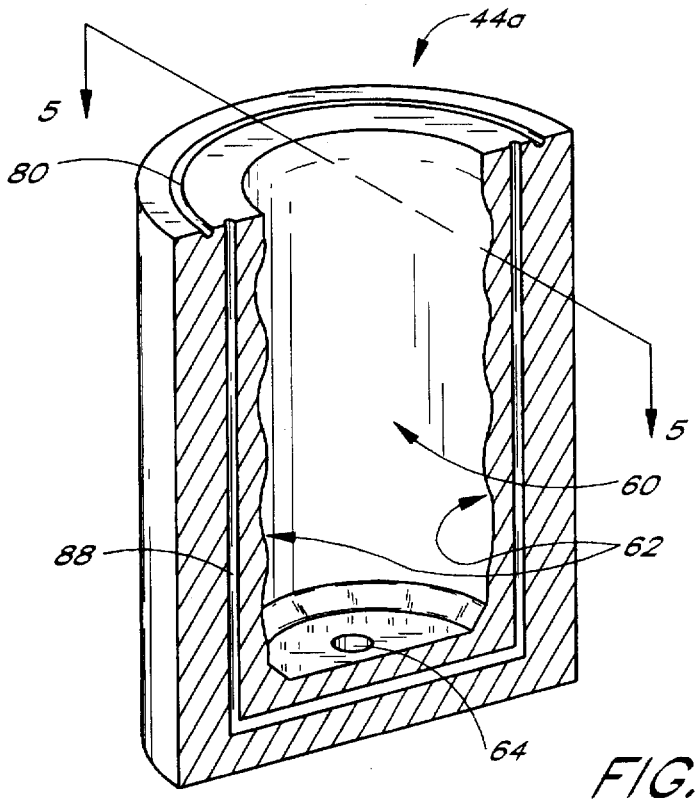
FIG. 5 is perspective view of one segment of a preferred non-conductive segmented die of the present invention.

Preferably, the die comprises two semi-cylindrical halves 44*a* and 44*b*, one of which is shown in FIG. 5. Because the die is a split type, comprising two semi-cylindrical halves, there are two diametrically opposed seams 46 which run longitudinally along the die when it is closed around a cylindrical workpiece.

When current 48 flows in one direction in the flux transfer member 7, a current 50 is induced in the workpiece 3 which flows in the opposite direction to that flux transfer member current 48. The current 50 in the workpiece 3 interacts with the magnetic field produced by the flux transfer member current 48 to both force the workpiece 3 material outward and away from the flux transfer member 7, and to dissipate the magnetic field as it penetrates the inner surface of the workpiece 3. The strength of the magnetic field undergoes an exponential decay as it penetrates the workpiece, with a decay constant that is, among other parameters, proportional to the square root of the oscillation period of the current pulsed or $T^{1/2}$ in terms of the waveforms illustrated in FIGS. 3*a* and 3*b*. This decay constant is commonly referred to as the "skin depth" for a given material at a given frequency of applied electromagnetic field, and represents the penetration depth into the material before the magnetic field strength is at 1/e of its initial value.

In most electromagnetic metal forming applications, the current discharge period producing the applied electromagnetic field is around 100 microseconds (corresponding to an inductor current oscillation frequency of about 10 kHz), and the workpiece is approximately 0.03 inch thick or more. In these cases, the workpiece thickness is close to or greater than the skin depth of the material, and therefore the magnetic field is dissipated by about 65% to 80% within the workpiece. In some prior art applications, the metal is 0.1 inches thick or more, and the magnetic field is dissipated almost to zero within the workpiece.

For very thin metal, however, the workpiece itself does not significantly dissipate the magnetic field, and a large component of it penetrates the die behind the workpiece as well. When the magnetic field penetrates a die made of electrically conductive material such as steel or another metal, an additional current 52 is induced in the die in the same direction as the current induced in the workpiece. This current induced in the die reduces the magnetic field strength in the region between the inductor and the die, thereby reducing the forming pressure on the workpiece. Because in the prior art the workpiece is typically thick relative to the skin depth of the workpiece material, die penetration of the magnetic field is typically not a design concern. Therefore, dies of comprising conductive metal, usually steel, are commonly used for their high mechanical strength and heat resistance.

For thin metal forming applications, though, the current induced in a steel or other conductive die prevents proper forming. Aluminum, for example, has a skin depth which varies from about 0.003 inches at 1 MHz to over 0.1 inches at 1 k/Hz. When forming thin metal, such as aluminum beverage containers with approximately 0.005 inch wall thickness, the magnetic field created by the inductor will therefore extend well into the die, thereby reducing the magnetic field strength which forms the workpiece 3.

For segmented dies, such as the two-piece die illustrated in FIGS. 4 through 7, the die current also can cause arcing at the junction of the die segments along the inside surface of the die 53. This is because the induced current 52 concentrates near the surface of the die, producing high voltages at the point 53 where the die segments diverge until arcing occurs. These arcs can burn the workpiece as it expands against the region of the seam, and thereby produce undesired surface imperfections in the formed material.

In accordance with the present invention, therefore, thin metal workpieces are formed using dies comprised of substantially non-conductive material. If the die is non-conductive, no die current is induced, and the magnetic field reduction in the region containing the workpiece is avoided. This improves the quality and efficiency of the forming process.

Many non-conductive dielectric materials may be used as dies for forming or shaping thin metal workpieces. Polycarbonate and phenolic plastics, for example, are suitable materials. In a preferred embodiment of the present invention, the die is comprised of a ceramic such as aluminum oxide. This material is especially suitable for two reasons. First, it has a high mechanical strength. Second, ceramics have high heat conductivity compared to most dielectric materials such as glass or plastic. This feature of ceramics can be beneficial for metal forming which involves a high repetition rate for the metal forming pulses as is required in any economically feasible production of aluminum beverage containers. Because both electrical energy dissipated by the coil and kinetic energy transferred by the workpiece must be absorbed by the die, the rate of heat transfer out of the system through the die can limit the pulse repetition rate. Die materials which are good conductors of heat are therefore especially preferred.

FIG. 5 illustrates one half of a split die for forming open top aluminum containers in accordance with the present invention. The split die body 44*a* comprises an approximately semi-cylindrical shell, with a hollow central region 60 having dimensions approximately equal to the dimensions of the aluminum container to be shaped, but having contoured sides 62 which are formed to the desired final non-cylindrical shape of the aluminum container. The complete die comprises an additional mating second semi-cylindrical half 44*b* which is not shown in FIG. 5. Because of the contoured sides of the aluminum container after being shaped in the die, solid cylindrical dies are generally not suitable because the container cannot be removed after forming. Segmented dies comprising more than two mating pieces can be utilized, however.

As the metal wall of the container 3 expands toward the surface of the die 44*a*, pockets of trapped air develop between the container and the die. This trapped air, which is highly compressed as the container wall approaches the surface of the die, causes a wrinkling in the surface of the formed container, resulting in a generally unacceptable final appearance. Escape holes may be provided in the surface of the die so that the air can escape, but if the holes are large enough to allow sufficient transfer of trapped air, the metal wall begins to form into the escape holes, again resulting in an unacceptable final appearance.

Accordingly, a vacuum is provided between the container wall and the surface of the die to remove pocket forming air. It has been found most preferable for successful forming to provide a vacuum of 28 in-Hg or more. Noticeable wrinkling has been found to remain under a vacuum of less than 27 in-Hg. Preferably, air is removed from the inside of the die through an opening 64 in the bottom portion of the die. The opening is preferably provided with a threaded nipple 66 on the outside surface of the die (illustrated in FIG. 6), to which a vacuum hose may be attached. Of course, many methods of evacuating the die will be apparent to those of skill in the art.

Figure 6:
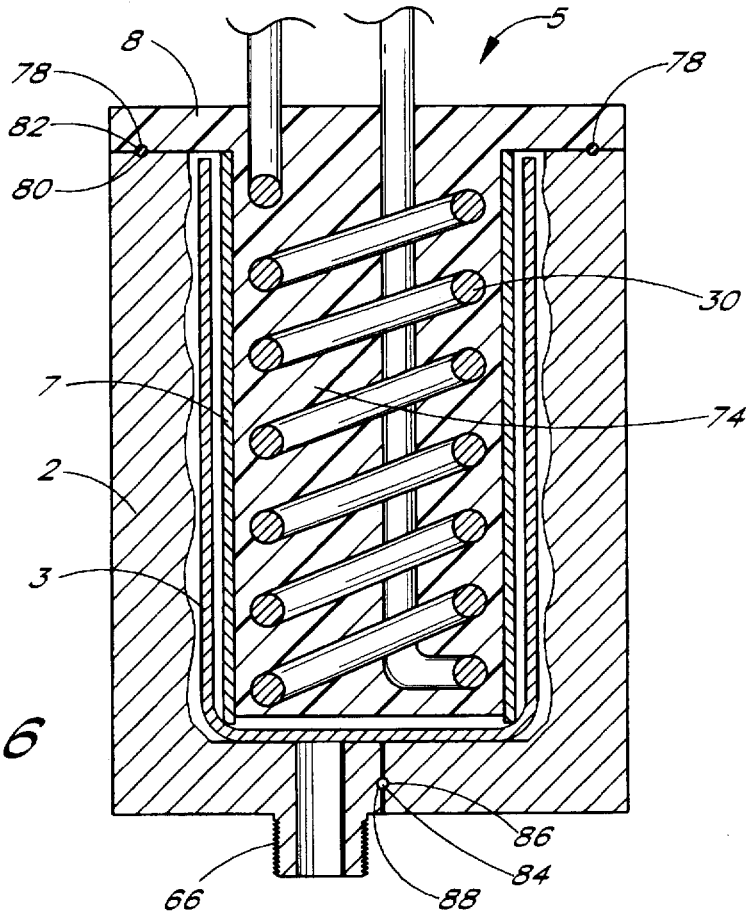
FIG. 6 shows a longitudinal cross section along lines 6—6 of the thin metal forming apparatus illustrated in FIG. 1.

Referring now to FIG. 6, the current carrying inductor 30 which produces the magnetic field is embedded in a solid plastic support structure 5 having a cylindrical shaft portion 74 which contains preferably 5 to 10 turns, most preferably 7 or 8 turns of 3/16 inch diameter tubing made of copper or a copper alloy such as beryllium copper in standard inductor configuration familiar to those in the art. Hollow tubing (rather than solid metal) is preferable in applications utilizing a high pulse duty cycle such as the large scale manufacture of stylized aluminum beverage containers because the tubing can be directly water cooled. A cross section of the inductor 30 turns are illustrated in FIG. 6 as embedded in the shaft portion 74 of the plastic support structure 5. The support structure further has an integral top flange portion 8 which mates with the top surface of the die 2. As described briefly above, the shaft portion 74 is provided with a flux transfer member 7 comprising a conductive split sleeve, which fits slidably over the shaft portion 74 and inside the container workpiece 3.

To maintain the vacuum during the forming process, the mating surfaces of the die are preferably sealed with resilient O-rings and strips. Most preferably, two seals are provided. Referring now to both FIGS. 5 and 6, between the bottom surface of the flange portion 8 and top surface of the die 2 is an O-ring 78, which rests in a channel formed by adjacent grooves 80, 82 in the die 2 top and flange portion 8, respectively. A resilient strip 84 which may preferably comprise neoprene is also preferably provided to form a seal at the mating surfaces of the two die halves 44*a*, 44*b*. In a manner similar to the O-ring seal described above, the strip 84 rests in a channel formed by adjacent grooves 86, 88 in each die half.

Figure 7:
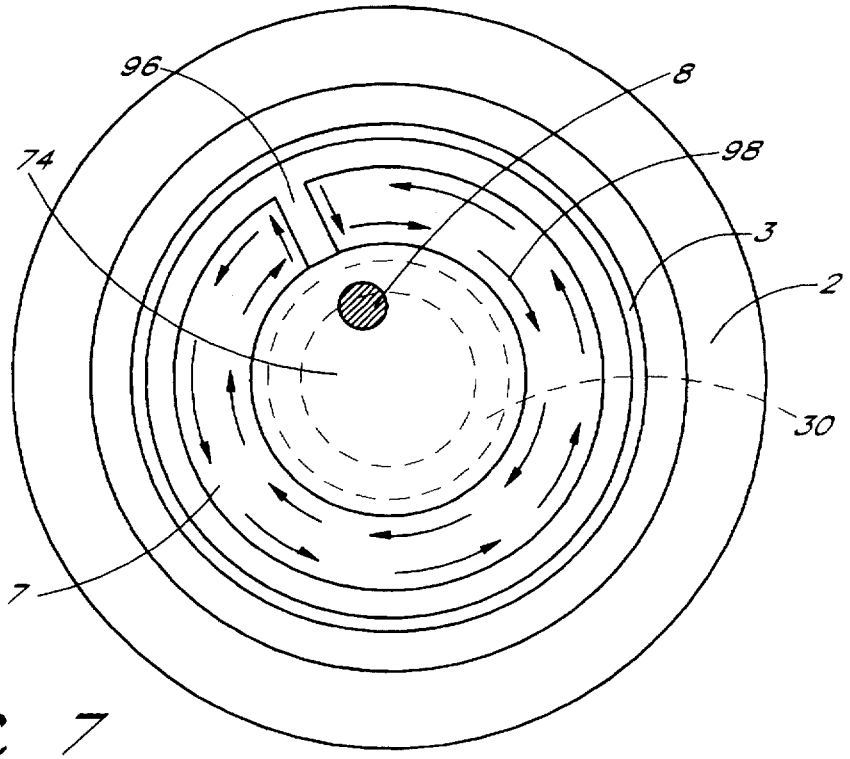
FIG. 7 shows an axial cross section along lines 4—4 of the thin metal forming apparatus illustrated in FIG. 1.

The function of the flux transfer member 7 can now be explained in more detail with reference to FIG. 7, which illustrates a top cutaway view of the apparatus of FIG. 1, also along lines 4–4 of FIG. 1. As can be seen in FIG. 7, a flux transfer member 7 comprising a split conductive sleeve is slidably mounted to the shaft portion 74 of the inductor 30 support structure. The flux transfer member 7 may be made of any highly conductive material such as aluminum or more preferably, copper or a copper alloy such as beryllium copper. Preferably, the flux transfer member 7 is about 2 to 20 millimeters thick, most preferably about 10 to 15 millimeters thick, which allows for water channels for cooling if needed or desireable in the application. The flux transfer member 7 is further provided with a longitudinally extending slit 96, which is preferably approximately one millimeter wide. Alternatively, the slit 96 could be only 0.015 or 0.020 inches wide and provided with an insulating fiberglass sheet secured inside the slit 96 with RTV or epoxy. The outside surface of the flux transfer member 7 is insulated with a thin fiberglass reinforced shrink tubing or other insulator to prevent any electrical contact between the flux transfer member 7 and the container workpiece 3.

The flux transfer member 7 acts as a secondary coil in the following manner. A current pulse in the inductor 30 induces a current 98 on the inside surface of the flux transfer member 7. This induced current is forced to the outside surface of the flux transfer member 7 at one side of the slit 96, and it continues around the outside surface of the flux transfer member 7 to the other side of the slit 96, at which point it completes the path back to the inside surface. Without the slit, the induced current 98 would remain on the inside surface of the flux transfer member 7, and the magnetic field produced by the current pulse would be dissipated in the flux transfer member 7 without reaching the container workpiece 3.

The benefit to providing the flux transfer member 7 when forming closed bottom containers is that suitable forming pressures can be generated closer to the bottom panel of the container than are possible without the flux transfer member 7. This is because the current is distributed substantially evenly along the entire length of the flux transfer member 7, and the flux transfer member 7 can be designed to fit snugly into the bottom of the container workpiece 3 below the lowest extent of the shaft portion 74 of the inductor 30 support structure 5. This allows the production of strong magnetic fields in the bottom section to form and shape even the lowermost portions of the container workpiece 3.

Improvements in forming efficiency can also be obtained by carefully controlling the oscillation frequency of the current pulse. Referring back to FIG. 3*b*, it may be noted that the velocity of the workpiece 3 towards the die produced by the positive pressure pulses as illustrated in FIG. 3*b* is proportional to the area under the pulse curve. The higher this velocity, the more effective and efficient is the forming process. The area under the pulse curve can be increased in two ways. Either the height can be increased, or the duration can be increased.

As was mentioned above, the skin depth of a material is proportional to the square root of oscillation period of the applied current pulse, or $T^{1/2}$, where T is the period illustrated in FIGS. 3*a* and 3*b*, and is equal to the inverse of the oscillation frequency of the current. The skin depth, it may be recalled, is a measure of the dissipation rate of the magnetic field within the workpiece. Because the dissipation is caused by the induced current in the workpiece, a fast dissipation, that is, a small skin depth, implies a high current in the workpiece. Because the Lorentz force on the workpiece is proportional to the induced current, reducing the skin depth increases the electromagnetic pressure on the workpiece. Therefore, reducing the period T increases the height of the pulses and thereby increases their area.

However, decreasing the period T decreases the duration of the pulses, thereby decreasing the area beneath the pulse curve. When forming thin metal workpieces, it has accordingly been found that continued decreases in the pulse period produces improvements in forming effectiveness and efficiency as improvements in pulse height outweigh reductions in pulse width until a threshold pulse period is reached. After this point improvements in pulse height are no longer adequate to compensate for reductions in pulse width and forming effectiveness and efficiency deteriorates with further decreases in pulse width.

For thin aluminum such as is used in aluminum containers, forming quality and efficiency has been found to be maximized by choosing a pulse period T which produces a skin depth approaching the wall thickness of the workpiece to be formed. This implies that the magnetic field is dissipated to about 37% of its initial value across the width of the workpiece itself when the forming efficiency of a thin workpiece is maximized.

Typically, electromagnetic forming machines operate in the 8 to 12 kHz range. The skin depth for aluminum at these frequencies is 0.05 to 0.033 inches. This is six to ten times the 0.005 inch thickness of an industry standard aluminum beverage container. An oscillation frequency of approximately 40 kHz produces a skin depth of near the desired workpiece thickness of 0.005 inches, and accordingly, a preferred embodiment of the present invention utilizes a capacitance 24 and inductance 30 which creates an oscillation frequency of about 20 to 60 kHz.

The foregoing description details certain preferred embodiments of the present invention and describes the best mode contemplated. It will be appreciated, however, that no matter how detailed the foregoing appears in text, the invention can be practiced in many ways and the invention should be construed in accordance with the appended claims and any equivalents thereof.

What is claimed is:

1. An apparatus for deforming a sheet metal workpiece comprising:

an inductor;

a substantially stationary flux transfer member substantially adjacent to said inductor, wherein the flux transfer member comprises a metal sleeve with a longitudinal slit;

a substantially electrically non-conductive die spaced away from a surface of said flux transfer member;

a substantially electrically conductive workpiece situated with at least one portion between said flux transfer member and said die such that a current flowing in said inductor induces a current in said flux transfer member which creates a magnetic field forcing said workpiece toward the surface of said die.

2. The apparatus of claim 1, wherein the die comprises a ceramic material.

3. The apparatus of claim 2, wherein the ceramic comprises aluminum oxide.

4. An apparatus for deforming a sheet metal workpiece comprising:

a capacitor;

an inductor interconnected with said capacitor;

a die spaced away from a surface of said inductor, wherein said die is comprised of substantially non-conductive material;

a substantially electrically conductive workpiece with thickness of less than approximately 0.01 inches situated with at least one portion between said inductor and said die such that a pulsed current flowing in said inductor creates a magnetic field forcing said workpiece toward a surface of said die;

wherein the capacitance of said capacitor and the inductance of said inductor define a current pulse width, and wherein said current pulse width is chosen to approximately maximize the transfer of kinetic energy to said workpiece.

5. The apparatus of claim 4 wherein said substantially non-conductive material comprises ceramic.

6. An apparatus for electromagnetically forming an open top metal container, said container comprising a substantially cylindrical side wall and integral bottom panel, said apparatus comprising:

a capacitor;

an inductor adapted to fit substantially inside said container, wherein said inductor is interconnected with said capacitor such that said inductor can be periodically connected across said capacitor when said capacitor is storing a charge, thereby creating a pulsed current through said inductor; and, a substantially non-conductive die adapted to substantially surround said container;

wherein the product of the capacitance of said capacitor and the inductance of said inductor determines a current pulse width, and wherein said current pulse width approximately maximizes the transfer of kinetic energy to said workpiece.

7. The apparatus of claim 6 wherein said die is comprised of ceramic.

8. The apparatus of claim 6 additionally comprising a flux transfer member situated between said inductor and said container.

9. The apparatus of claim 8 wherein said flux transfer member comprises a metal sleeve having a longitudinally extending slit.

10. A method of forming a stylized aluminum container comprising:

placing an inductor inside an unstylized aluminum container;

forming a die from substantially non-conductive material;

placing said unstylized aluminum container inside said die, said die having an inner surface contoured in the desired stylized aluminum container configuration;

adjusting the width of a current pulse conducted by said inductor so as to substantially maximize the transfer of kinetic energy to the aluminum container.

11. The method of claim 10 additionally comprising the step of forming said die from ceramic.

12. The method of claim 10 additionally comprising the step of placing a flux transfer member around said inductor prior to placing said inductor inside said unstylized aluminum container.

13. A method of electromagnetically forming aluminum having a thickness of approximately 0.004 to 0.008 inches comprising:

placing at least a portion of said aluminum proximate to an inductor; and, conducting a time varying current through said inductor, wherein the waveform of said time varying current comprises damped oscillations, and wherein the frequency of said oscillations is approximately 20 to 60 kilohertz.

14. The method of claim 13 additionally comprising the step of placing a die comprised of substantially non-conductive material adjacent to said aluminum such that said aluminum is forced against a surface of said die.

15. The method of claim 14 additionally comprising the step of evacuating the air from the region between said aluminum and said die.

16. A method of forming an aluminum beverage container having a thickness of approximately 0.004 to 0.008 inches comprising:

placing at least a portion of said aluminum beverage container proximate to an inductor; and, conducting a time varying current through said inductor, wherein the waveform of said time varying current comprises damped oscillations, and wherein the frequency of said oscillations is approximately 20 to 60 kilohertz.

17. The method of claim 16 wherein said placing step comprises placing said inductor substantially inside said beverage container.

18. An apparatus for deforming a sheet metal workpiece comprising:

a flux transfer member, wherein said flux transfer member comprises a metal sleeve with a longitudinal slit;

a die of generally hollow cylindrical configuration comprising a substantially electrically non-conductive inner surface defining an approximately cylindrical interior region; and, a helical inductor, wherein said helical inductor is surrounded by an insulating material, and wherein said helical inductor and said flux transfer member are sized so as to fit substantially within said interior volume of said die.

19. The apparatus of claim 18, wherein the die comprises a ceramic material.

20. A method of electromagnetically forming an open topped aluminum can comprising the steps of:

placing an open topped aluminum can into a die having a substantially electrically non-conductive inner surface;

placing an insulated helical inductor into said aluminum can; and, forcing current through said inductor.

21. The method of claim 20, wherein said current comprises damped oscillations, and wherein the frequency of said damped oscillations is approximately 20 to 60 kHz.

* * * * *